US007508738B2

(12) United States Patent
Meier et al.

(10) Patent No.: US 7,508,738 B2
(45) Date of Patent: Mar. 24, 2009

(54) DISPLAY DEVICE FOR A WATCH

(75) Inventors: Willy Meier, Fontaines (CH); Paul Gerber, Zürich (CH)

(73) Assignee: Eterna SA (CH)

( * ) Notice: Subject to any disclaimer, the term of this patent is extended or adjusted under 35 U.S.C. 154(b) by 404 days.

(21) Appl. No.: 10/564,548

(22) PCT Filed: Jul. 8, 2004

(86) PCT No.: PCT/CH2004/000433

§ 371 (c)(1),
(2), (4) Date: Jan. 13, 2006

(87) PCT Pub. No.: WO2005/006087

PCT Pub. Date: Jan. 20, 2005

(65) Prior Publication Data

US 2006/0215498 A1 Sep. 28, 2006

(30) Foreign Application Priority Data

Jul. 14, 2003 (EP) ..... 03405532

(51) Int. Cl.
*G04C 3/00* (2006.01)
*G04F 7/00* (2006.01)
*G04B 1/00* (2006.01)
*G04B 19/00* (2006.01)

(52) U.S. Cl. ..... 368/64; 368/101; 368/106; 368/203; 368/221; 368/223

(58) Field of Classification Search ..... 368/220, 368/221, 223, 139, 145, 28, 37, 62, 71–77, 368/64, 101, 106, 203
See application file for complete search history.

(56) References Cited

U.S. PATENT DOCUMENTS 3,675,413 A 7/1972 Fluck
4,363,553 A * 12/1982 Thomi et al. ..... 368/140
7,029,169 B2 * 4/2006 Takahashi et al. ..... 368/106
7,070,320 B2 * 7/2006 Schmiedchen et al. ..... 368/98
7,192,181 B2 * 3/2007 Schmiedchen ..... 368/140
2004/0170088 A1 9/2004 Seyr
2005/0007888 A1 * 1/2005 Jolidon ..... 368/110

FOREIGN PATENT DOCUMENTS

EP 0806712 A2 11/1997
FR 1522084 A 4/1968
WO WO 02/093273 A1 11/2002
WO WO 2005/006088 A1 1/2005

OTHER PUBLICATIONS

PCT International Search Report, for PCT/CH2004/000433, mailed Nov. 26, 2004 (2 pages).
PCT International Preliminary Report, for PCT/CH2004/000433, mailed on Jun. 24, 2005 (5 pages).

* cited by examiner

*Primary Examiner*—Vit W Miska
(74) *Attorney, Agent, or Firm*—Finnegan, Henderson, Farabow, Garrett & Dunner, LLP

(57) ABSTRACT

A display device is provided for a watch movement provided with a final gear train intended to drive, at least in a mediated way, means of displaying the time and an energy source driving the final gear train. In one implementation, the display device comprises a display disk for an additional function, and a display gearing of which one moving part carries the display disk. The display device also comprises a second energy source connected mechanically to the display gearing and operating means for the display gearing, designed so as to cause the gearing to be driven by the second energy source when the information for display has to be changed.

10 Claims, 6 Drawing Sheets

DISPLAY DEVICE FOR A WATCH

This application is a national stage filing under 35 U.S.C. § 371 of International Application No. PCT/CH2004/000433, filed on Jul. 8, 2004.

TECHNICAL FIELD

The present invention relates to display devices intended to be fitted to watch movements of the type comprising a final gear train and an energy source driving this gear train. This device comprises:

a display disk, and display gearing associated with a complementary function and having a moving part which carries the disk.

In the present description, the term "disk" denotes a round part, generally made of plastics or metal, which may or may not be centrally pierced, and which carries information to be displayed.

BACKGROUND

The display of information by means of one or more disks is known to those skilled in the art. One of the most frequent applications relates to the indication of the day and date, the display being provided by means of two disks which jump once per day. To achieve this jump, the movement is generally provided with a spring, which is set by the final gearing, and which is released at about midnight, thus causing the date and day to change to the next setting. It can also be driven initially with a slow movement provided by the gearing of the watch, and then with a jump created by a jumper-spring.

If the information changes more frequently than once per day, the mechanism becomes more complicated in its operation, since the energy available for each jump is considerably reduced. This problem can be resolved by driving the disks continuously, as proposed in CH 531742. This causes the figures to move slowly in an aperture. This makes it difficult to read the information, since several figures are visible for the same piece of information.

The object of the present invention is to provide an optimal drive for the disk or disks, even if they are large, without affecting the operation of the watch.

SUMMARY OF THE INVENTION

For this purpose, the device according to the invention is characterized in that it additionally comprises:

a second energy source, connected mechanically to the display gearing, and operating means for the gearing, designed so as to cause the gearing to be driven by the second energy source when the information for display has to be changed.

Thus practically no energy is drawn from the final gearing, even with disks of very large diameter. In a mechanical watch, this makes it possible to prevent the disk drive from reducing the amplitude of the balance. In a quartz watch, the energy to be delivered by the motor does not undergo fluctuation, and therefore the power reserve can be increased without any effects on operation.

Advantageously, the second energy source is mechanical, in the form of a barrel. The device according to the invention also comprises means of winding up this energy source.

Such a device can be fitted to a watch movement of the chronograph type, comprising:

chronograph gearing in which one moving part completes one revolution per minute, designed to carry means for displaying the seconds of the measured time, together with a clutch designed to connect the chronograph to said gear train or disconnect it therefrom, and to cause the starting and stopping of the chronometric measurement of a period of time.

The device comprises drive means which are controlled by the chronograph gearing and which cause the display gearing to be driven by the barrel.

In this device, the display gearing is designed in such a way that the disk displays measured periods equal to or greater than a minute.

Such a device can comprise a plurality of display disks and a plurality of barrels, each barrel driving one disk.

To achieve a regular drive, the device according to the invention comprises:

a regulation system, designed to stabilize the rotary movement of said gearing, and a trigger mechanism operated, at least in a mediated way, by the final gear train, and causing the disk to be driven by the barrel, by means of the display gearing.

The regulation system advantageously comprises a flywheel and a cam provided with a locking member and rotating in synchronization with the flywheel. The trigger mechanism comprises a lever designed so that it can occupy a first position in which it interacts with the locking member to immobilize the regulation system, a second position in which it releases the cam and allows the regulation system to rotate, and a third position in which it bears against the cam until it interacts again with the locking member.

In such devices, the use of hammers to reset the disks to zero, a common practice in chronographs, can cause excessive pressure. For this reason, the device according to the invention advantageously comprises:

a zero resetting mechanism comprising a positioning member, an index pin positioned on the moving part of the display gearing carrying the disk and interacting with the positioning member to position the disk, and operating means designed in such a way that, when the zero resetting mechanism is activated, the mechanical energy source drives the moving part of the display gearing until the index pin interacts with the positioning member to position the disk.

Zero resetting can thus be carried out without requiring any effort on the user's part, even with a disk or disks of large diameter.

BRIEF DESCRIPTION OF THE DRAWINGS

Other advantages and characteristics of the invention will be made clear by the following description, which refers to the attached drawing in which.

DETAILED DESCRIPTION

Figure 1:
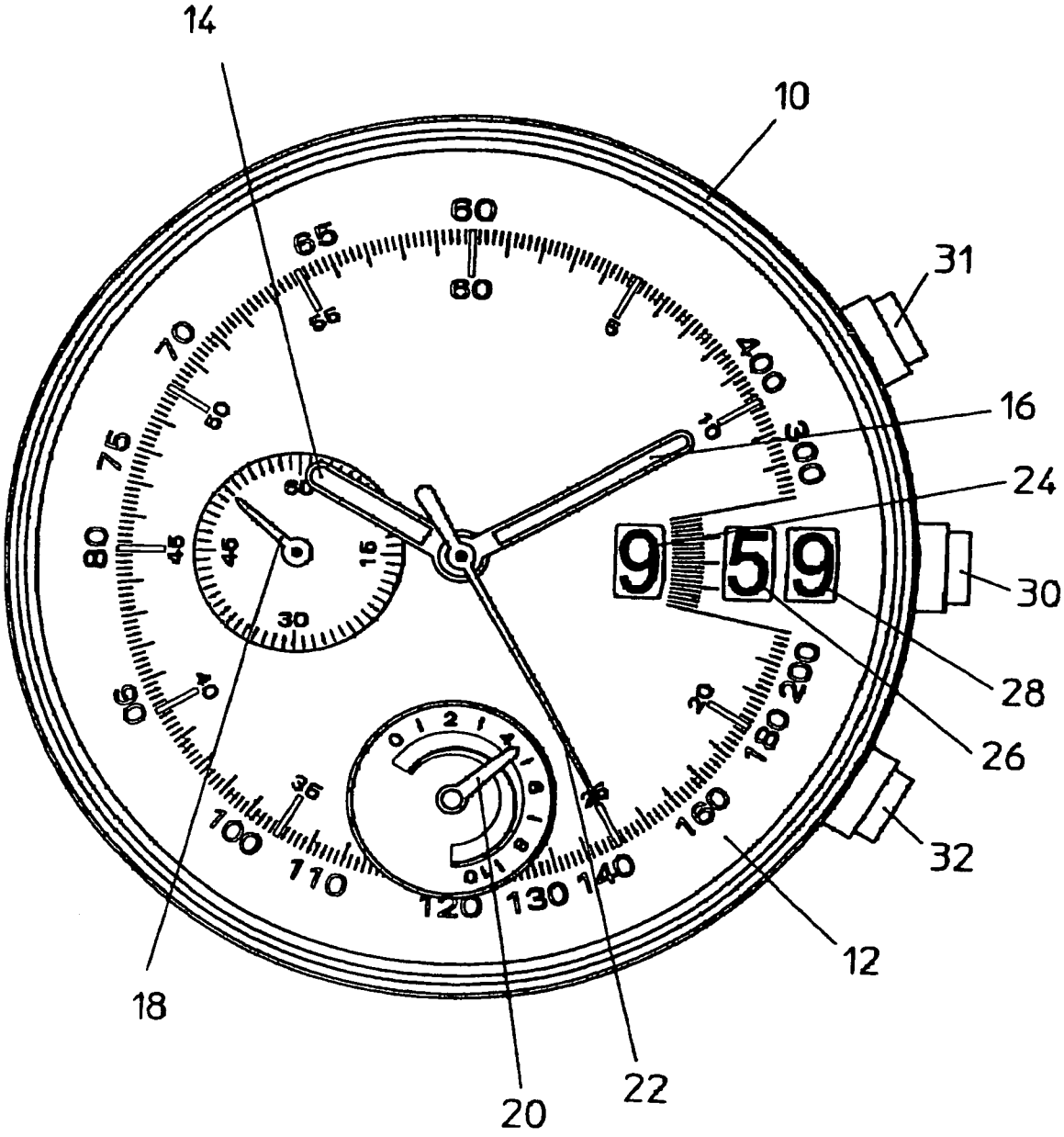
FIG. 1 shows a watch of the chronograph type, provided with a display device having measured time disks.

The watch shown in FIG. 1 has a case 10 forming a housing in which a movement is located. This movement is provided with a chronograph mechanism, of a well-known type, together with a display device according to the invention which is described more fully below.

The movement has a dial 12, an hour hand 14, a minute hand 16, a second hand 18, and a power reserve hand 20, as well as a measured time second hand 22. The dial 12 is provided with three apertures through which are visible disks 24, 26 and 28, displaying respectively the hours, the tens of minutes and the units of minutes of measured time, thus providing the display function of the device according to the invention.

A rewinding and time setting crown 30 and push buttons 31 and 32 are positioned in a conventional way on the edge of the case 10. The crown 30 can be used to provide the mechanical energy required for the operation of the movement, by rewinding a barrel spring, as explained below. The push buttons 31 and 32, respectively, cause the starting and stopping and the zero resetting of the chronograph mechanism and its display device.

The movement is based on a chronograph caliber such as that marketed by the ETA SA company of Switzerland under the reference number 7750. This movement comprises a bottom plate 33, shown in FIG. 2, a chronograph gearing and a start and stop mechanism, which are only partially visible in the drawing and which are well known to those skilled in the art. It also comprises a barrel, a final gearing, an escapement and a balance. The barrel supplies energy in a conventional way to the final gearing, which delivers it to the escapement, which converts the rotary motion of the gearing to reciprocating motion to drive the balance.

The chronograph gearing comprises a measured seconds wheel, which carries the measured second hand 22, and a measured minute wheel 34 driven in a conventional way by the measured seconds wheel at a rate of one step every minute. In a chronograph with a display using hands, the minute wheel 34 carries the measured minute hand.

Figure 2:
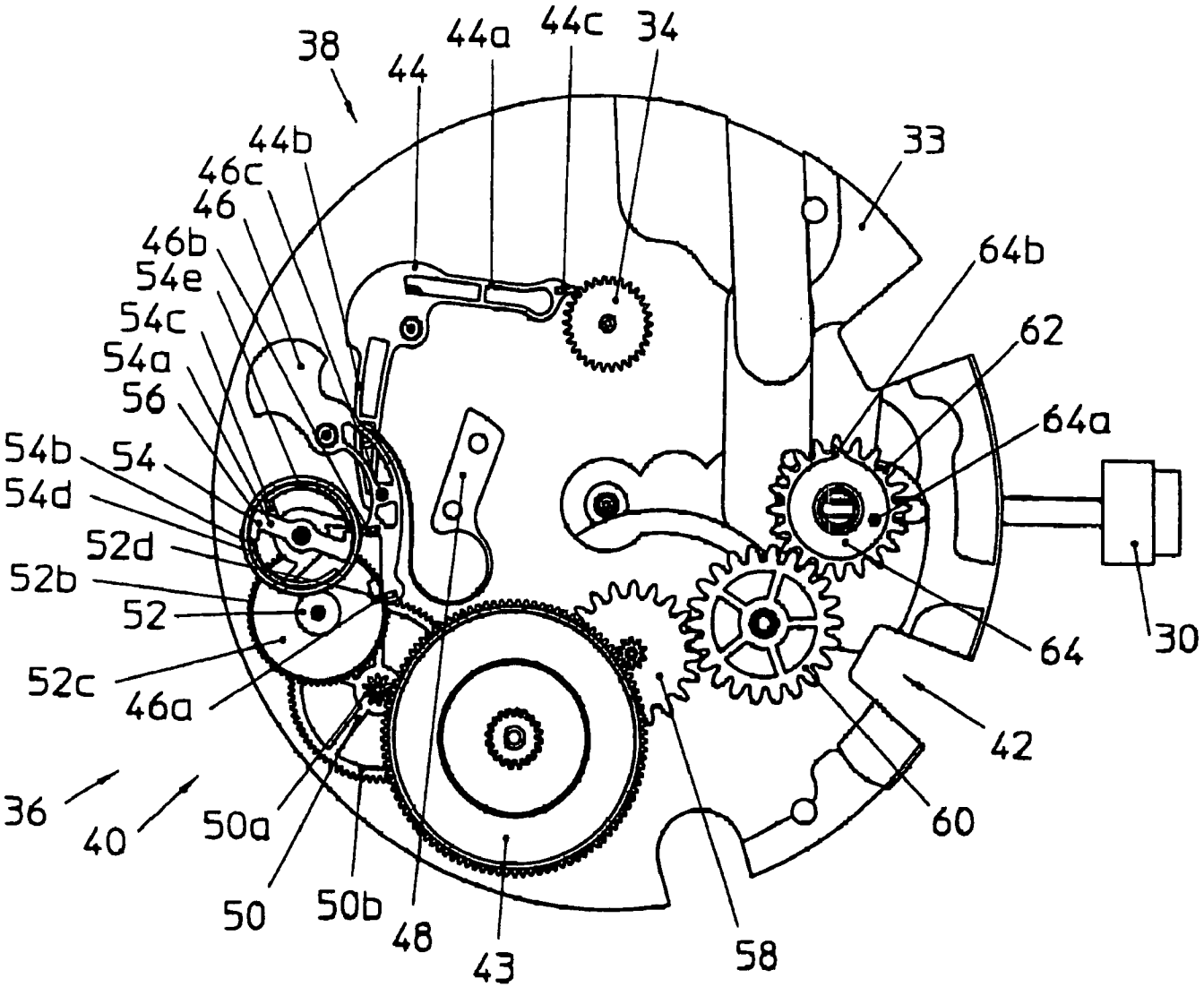
FIGS. 2 to 4 show the mechanisms which are incorporated in the display device for driving the disks provided in the watch of FIG. 1.

The display device according to the invention has means 36 for driving the units disk 28, shown more fully in FIG. 2, positioned on the bottom plate 33. These drive means 36 comprise a trigger mechanism 38 operated by the wheel 34, a regulation system 40 released by the trigger mechanism 38, a drive gearing for the display 42 of the units disk 28 and an energy source consisting of a barrel 43 which supplies its energy to both the regulation system 40 and the gearing 42.

More precisely, the trigger mechanism 38 is formed by two levers 44 and 46, mounted pivotably on the bottom plate 33, and by a spring 48. The lever 44 has two arms 44*a* and 44*b* positioned on either side of its pivot point, the arm 44*a* being provided, at its free end, with a finger 44*c* positioned so as to engage with the teeth of the wheel 34.

The lever 46 is provided with two pallets 46*a* and 46*b* intended to interact with the regulation system 40, as explained below, and a pin 46*c* interacting with the lever 44. It is kept in the rest position, with the pallets 46*a* and 46*b* retaining the regulation system 40, by the action of the spring 48. The levers 44 and 46 are designed and interact with each other so that, when the wheel 34 raises the lever 44, the arm 44*b* applies a force opposing that of the spring 48 to the pin 46*c*. This causes the lever 46 to pivot, which disengages the pallets 46*a* and 46*b* from the regulation system 40.

The regulation system 40 comprises a speed multiplication gear train having two moving parts 50 and 52 and a flywheel 54. The moving part 50 comprises a pinion 50*a*, which engages with the barrel 43, and a wheel 50*b* which drives the moving part 52 by means of its pinion which is not shown in the drawing.

This moving part also has a wheel 52*b* and a cam 52*c*. The wheel engages with a pinion, not shown in the drawing, attached to the flywheel 54. The cam 52*c* takes the form of a washer provided with a notch 52*d*. It interacts with the pallet 46*a* of the lever 46, which, by the action of the spring 48, is kept bearing against the periphery of the cam or is kept engaged in the notch 52*d*, according to the position of the moving part 52.

The flywheel 54 is provided with two arms 54*a*, each of which carries a blade 54*b*, together with three retaining fingers 54*c*, positioned radially and designed to interact with the pallet 46*b*. Each of the blades 54*b* has a resilient portion 54*d* in the form of an arc concentric with the axis of rotation of the flywheel, fixed to one of the arms 54*a* at one of its ends, and extending at an angle of approximately 90°. Each resilient portion 54*d* is provided at its other end with an inertial and braking weight 54*e* intended to interact with a drum 56 surrounding the flywheel 54 and fixed to the bottom plate 33. More precisely, when the flywheel 54 rotates, the resilient portions 54*d* of the blades 54*b* are deformed elastically under the action of their inertial weights 54*e*, which rub against the drum 56.

The display drive gearing 42 has a moving part 58, engaging with the teeth of the barrel 43 by means of its pinion, and a transmission gear 60, driven by the wheel of the moving part 58, and driving a units wheel 62. The latter wheel carries the units disk 28, together with a trigger cam 64, which is provided with a pin 64*a* and a finger 64*b* whose functions are detailed below. The moving parts of the regulation system 40 and of the gearing 42 are designed in such a way that the wheel 62 rotates through 36° for each rotation of the moving element 52.

Whenever the wheel 34 raises the finger 44*c* and consequently drives the levers 44 and 46, the pallets 46*a* and 46*b* release the cam 52*c* and the fingers 54*c* respectively. Thus the regulation system 40 starts to rotate at a speed regulated by the friction of the weights 54*e* against the drum 56. At the same time, the drive gearing 42 rotates and advances the wheel 62 through 36°, thereby advancing the units disk 28 by one step, the display visible through the aperture being incremented by one unit.

As soon as the wheel 34 releases the finger 44*c*, the lever 46 falls back under the action of the spring 38. The pallet 46*a* then bears on the cam 52*c*, without significantly impeding its movement. The cam therefore continues to rotate until the pallet 46*a* falls back into the notch 52*d*. The pallet 46*b* then locks the flywheel by interacting with one of the fingers 54*c*.

This structure makes it possible to explain the operating principle of the device in a simple way, since the regulation and drive functions are separate. It would also be possible to simplify the structure by combining these functions, by the engagement of the pinion of the moving part 52 with a wheel which would carry the moving part 58, the transmission gear 60 or the wheel 62.

Figure 3:
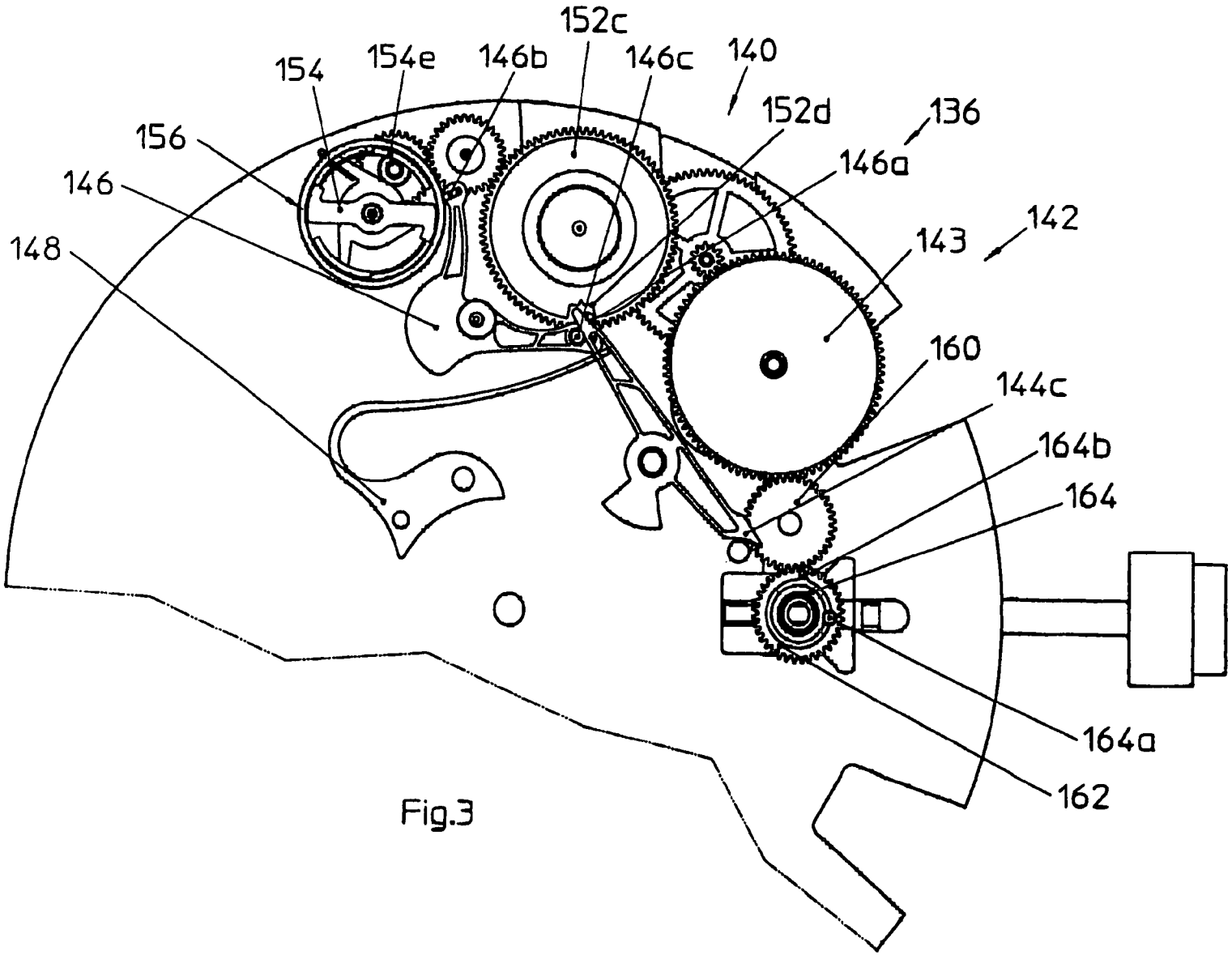

FIG. 3 shows means 136 for driving the tens disk 26. These means are essentially similar to the means 36 for driving the units disk, the components having the same reference numerals as those of the drive means 36, with the addition of a "1" in the form of a hundreds digit.

The operation of the drive means 136 is entirely comparable to the operation of the drive means 36.

Whenever the units disk 28 has completed one revolution, passing from 9 to 0, carrying the cam 64 with it, the finger 64*b*, shown in FIG. 2 only, raises the finger 144*c* of the lever 144. The lever 144 raises the pin 146*c* and causes the lever 146 to pivot, thus setting the spring 148, while the pallets 146*a* and 146*b* release the regulation system 140. The barrel 143 is then no longer restrained. It drives the flywheel 154, whose weights 154*e* come into contact with the drum 156, thus regulating the movement of the barrel 143 and of the drive gearing 142 of the tens of minutes disk, whose wheel 162 carries the tens disk 26.

As soon as the cam 64 ceases its movement, it releases the levers 144 and 146, so that the spring 148 causes the pallet 146*a* to bear against the cam 152*c*. When this cam has completed one revolution, the pallet 146*a* falls back into the notch 152*d* of the cam 152 and prevents its movement. In this way the tens disk 26 has jumped by one step.

The moving parts of the drive gearing 142 and of the regulation system 140 are designed in such a way that the tens disk 26 rotates through 60° for each step, this disk carrying the numbers 0 to 5.

The wheel 162 is also provided with a cam 164, having a pin 164*a* and a finger 164*b* designed to cause the hour disk 24 to jump, as explained below. The hour disk 24 is driven by drive means 236, shown in FIG. 4 and similar to the drive means 36 and 136, the components having the same reference numerals as those of the drive means 36 and 136, with the addition of a "2" in the form of a hundreds digit.

The operation of the drive means 236 is entirely comparable to the operation of the drive means 36. In this case, however, the number of moving parts incorporated in the regulation system 240 and the drive gearing 242 is greater. This does not modify its operation in any way.

Thus, whenever the tens of minutes disk 26 moves from 5 to 0, the finger 164*b* of the cam 164 (FIG. 3) raises the finger 244*c*, causing the lever 244 to swing and, by means of the pin 246*c*, also causing the lever 246 to swing, thus setting the return spring 248. The pallets 246*a* and 246*b* release the regulation system 240, so that the barrel 243 can rotate, and the hour disk drive gearing 242 can rotate with it. The drive gearing 242 comprises a moving part 260 positioned concentrically with the wheels 62 and 162, and provided with a pin 260*a* whose function is detailed below.

The wheel 262, which carries the disk 24, takes the form of a ring surrounding the centre of the movement in an off-centre way, and kept in place by means of a plate 263, fixed to the bottom plate 33 by means of screws which are not shown in the drawing, and pierced with a hole through which pass the shaft of the measured seconds wheel and the moving parts carrying the hour hand 14 and minute hand 16.

Because of the drive means 36, 136 and 236, the disks 24, 26 and 28 are driven without any increase in the load on the barrel causing the rotation of the final gearing. Thus the amplitude of the balance is not affect by the jumps of the display disks.

Figure 5A:
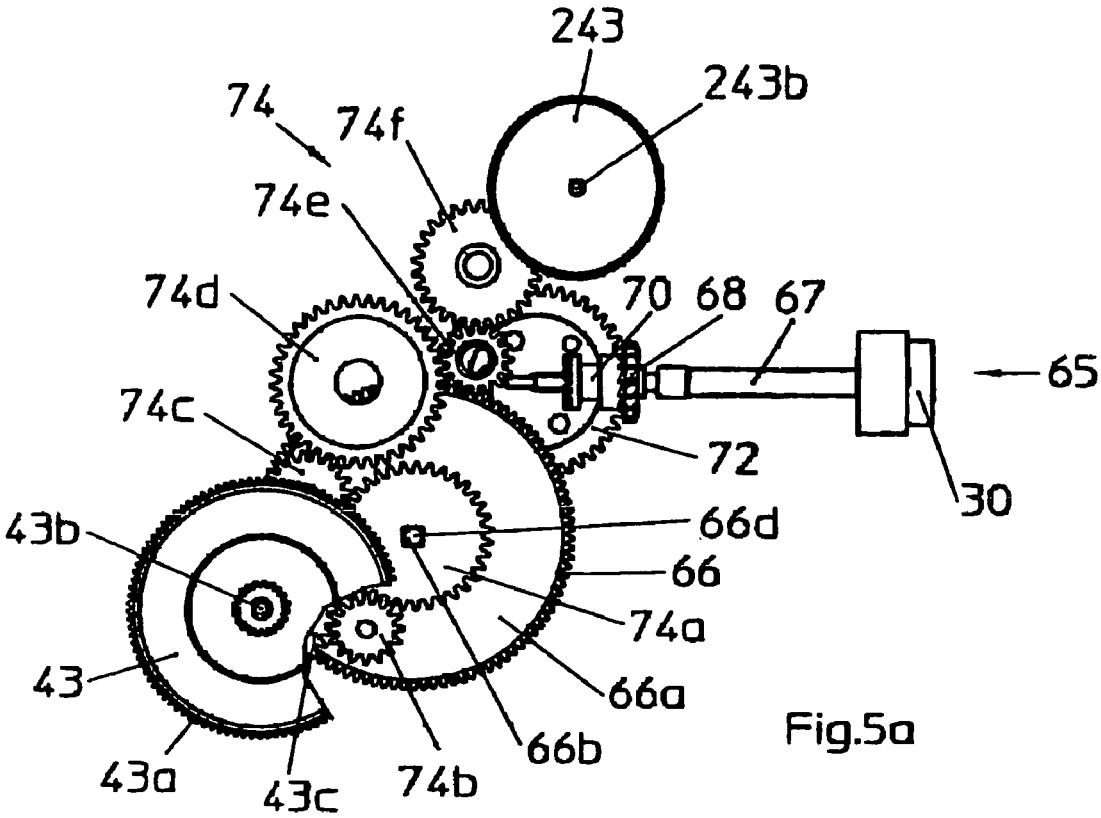
FIGS. 5*a* and 5*b* show the mechanism for winding the barrels incorporated in this watch.
Figure 5B:
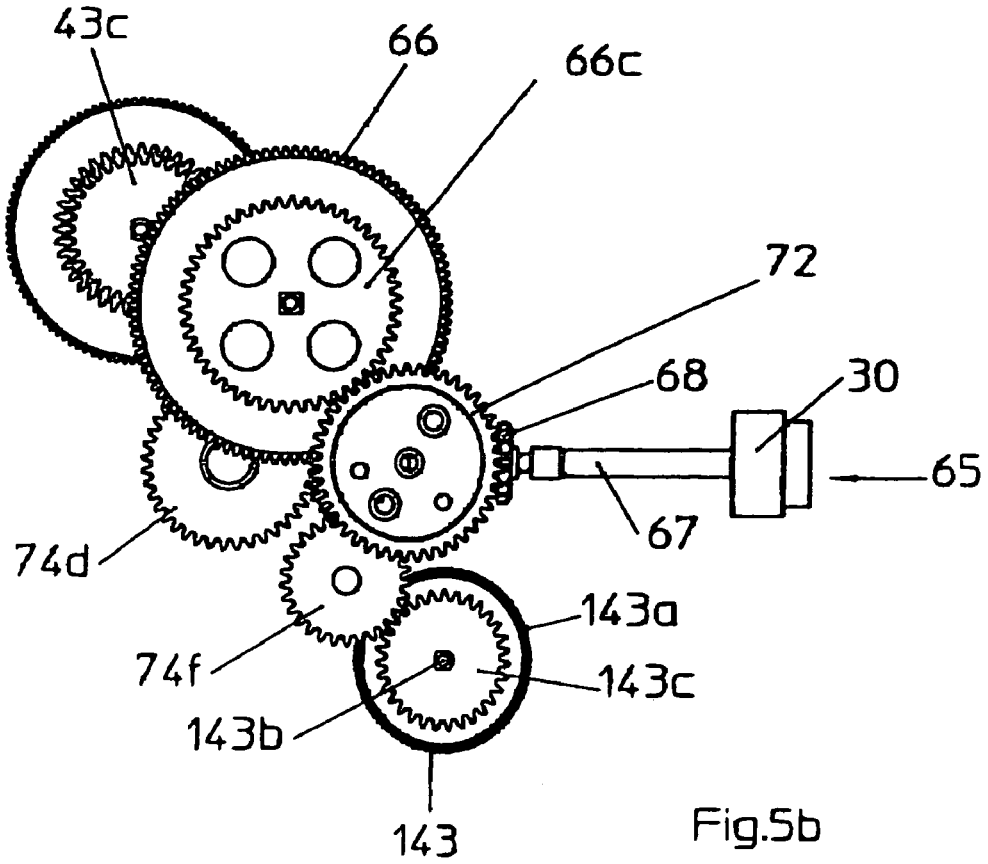

FIGS. 5*a* and 5*b* show the opposite sides of a rewinding mechanism 65 for the barrel springs incorporated in the movement. In addition to the winding of the barrels 43, 143 and 243, it also rewinds the aforementioned barrel 66 intended to drive the final gearing. Each of these barrels has a drum identified by the letter a, an arbor b, and a spring not shown in the drawing and having one end fixed to the arbor b, the other end interacting with the inner wall of the drum a by means of a sliding flange. A ratchet wheel, identified by the letter c, is fixed to the arbor b.

It will be seen that the barrels 143 and 243, shown in FIGS. 5*b* and 5*a* respectively, are coaxial. Their arbors 143*b* and 243*b* are designed to be fixed with respect to rotation, and both driven by the ratchet wheel 143*c*.

These figures also show the rewinding and time setting crown 30. This is fixed to a rod 67 providing a link between the outside and the inside of the case 10. A rewinding pinion 68 and a sliding pinion 70 are mounted pivotably on the rod 67, are linked mechanically to each other by Breguet teeth, and interact with a rewinding and time setting mechanism, in a way which is customary for this type of movement, but which is not shown, in order to avoid over-complicating the drawing.

A ring gear 72, mounted in a freely rotatable way on a bridge piece not shown in the drawing, engages with the rewinder pinion 68 and with the ratchet wheel 66*c* of the barrel 66, shown in FIG. 5*b*.

With this configuration, the barrel 66 can be rewound simply by rotating the crown 30 fixed to the rod 67 when it is in the pushed-in position. The rod 67 drives the sliding pinion 70 and by means of this pinion drives the rewinder 68, which is connected to the ring gear 72 which sets the spring of the barrel 66 by means of the ratchet wheel 66*c* and the arbor 66*b*.

The drive is in one direction only, the sliding pinion 70 and the rewinder pinion 68 being disengaged from each other by means of the Breguet teeth.

A train of transmission gears 74 interconnects the ratchet wheels. More precisely, a first transmission gear 74*a* is mounted on a square section 66*d* of the arbor 66*b*. It drives a second transmission gear 74*b* engaged with the ratchet wheel 43*c*. This ratchet wheel is connected to the ratchet wheel 143*c*, shown in FIG. 5*b*, by four transmission gears 74*c* to 74*f*, shown in FIG. 5*a*.

The number of transmission gears (even or odd) lying between two ratchet wheels is determined by the direction of rotation in which the spring is wound.

Clearly, in order to rewind all the barrels, each of their ratchet wheels must interact with a pawl, not shown in the drawing, which prevents the unwinding of the spring contained in the drum.

Thus, the rotation of the crown 30 winds up the four barrels 66, 43, 143 and 243. The barrels can all be fully wound, regardless of their initial state, because they are all fitted with sliding flanges.

The device described above can be used to drive each of the disks of the chronograph display by means of a barrel assigned to each disk. Thus only the energy required to drive the measured seconds and minute hands and to trigger the device is taken from the final gearing.

In a variant which is not shown, it would also be possible to have a single barrel providing the functions of the barrels 143 and 243. It would simply be necessary to replace the transmission gear 160 with a wheel having two superimposed toothed sectors, one being intended to drive the tens of minutes disk and having the same number of teeth as the wheel 162, while the other is intended to drive the hour disk and has one tenth of the teeth of the wheel 262. In this case, it would be necessary to provide means for positioning the disks 24 and 26, as well as zero resetting hammers, since the wheels carrying the disks would not be in permanent engagement with the gearing.

Since the hour disk 24 completes a maximum of only nine steps and one revolution, it is also possible to store the energy required to drive it in a device other than a barrel, for example in a spring interacting with a spiral.

Figure 6:
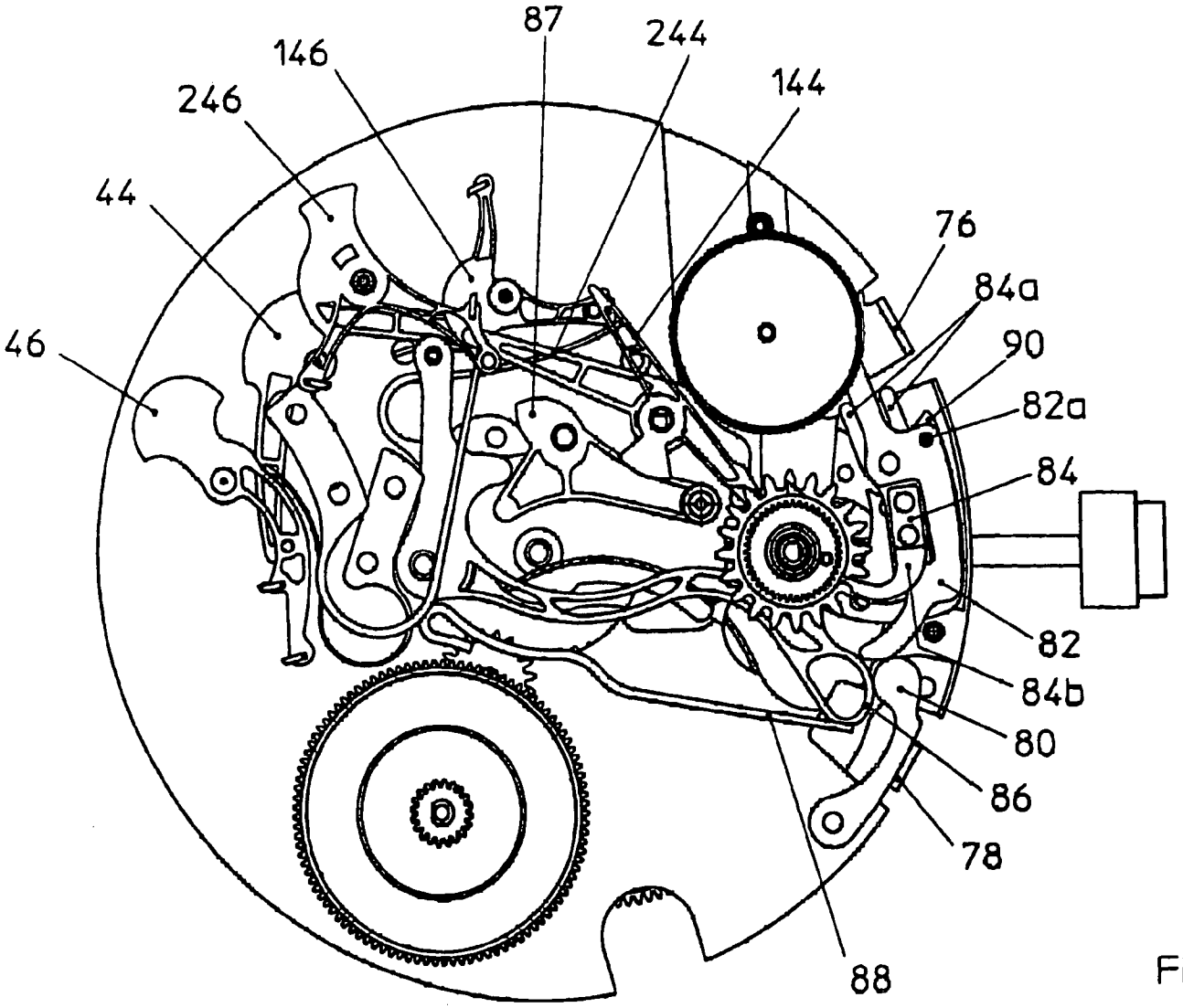
FIG. 6 relates to the mechanism for causing the starting and stopping of a measurement, and for causing the zero resetting of the disk display mechanism.

The display device according to the invention also has a zero resetting mechanism for the disks 24, 26 and 28, shown partially in FIG. 6. It is operated by the push buttons 31 and 32, shown in FIG. 1. It interacts with an operating lever 76, forming part of the chronograph mechanism, activated by the push button 31 and activating a clutch which, in a conventional way, connects the final gearing to the wheel 34, by means of a chronograph seconds wheel not shown in the drawing.

In a conventional way, a first press on the push button 31 causes the measurement to start and engages the clutch. A second press stops the measurement by disengagement.

Figure 4:
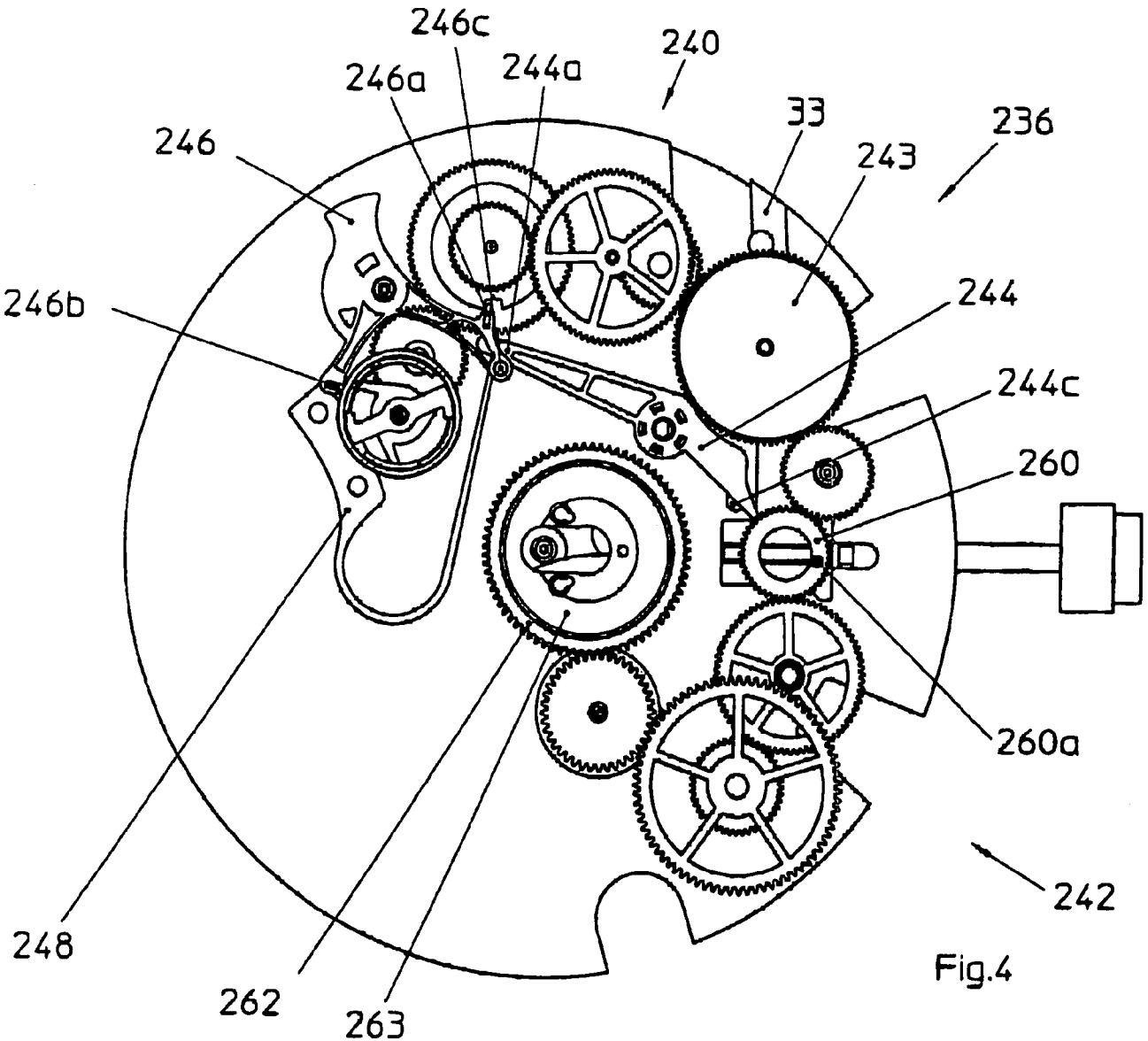

As soon as the chronograph mechanism is triggered, its gearing is put into movement, the wheel 34 being driven at one step per minute, causing the jumps of disks described with reference to FIGS. 2 to 4.

After the measurement has been made and the time has been read, the disks can be reset to zero by pressing the push button 32, which operates the zero resetting means incorporated in the chronograph mechanism. These means comprise, in a conventional way, a zero resetting lever 78 which operates a hammer which resets the chronograph seconds wheel to zero.

The zero resetting mechanism of the device according to the invention comprises:

- a operating lever 80,
- a jumper-spring balance 82 provided with a jumper-spring pin 82*a*,
- a disk positioning member 84, provided with two fingers 84*a* interacting with the balance 82 and two superimposed positioning hooks 84*b*, whose function is detailed below.
- a triggering balance 86,
- a lever 87 operated by the balance 86,
- a spring 88, interacting with the balance 86, and
- a jumper-spring 90, shown only partially in the figure and interacting with the pin 82*a* to position the balance 82.

In their rest position, the hooks 84*b* are positioned so as to interact with the pins 64*a*, 164*a* and 260*a*, to determine the initial position of the disks 24, 26 and 28, as explained below.

When a measurement is started by pressing the push button 31, the operating lever 76 makes the balance 82 swing, thus driving the positioning member 84 by means of the fingers 84*a* into the position shown in FIG. 6. The balance 82 is kept in its new position by the jumper-spring 90. Thus the positioning hooks 84*b* are moved away from the pins. The disks 24, 26 and 28 are no longer restrained and can therefore be made to rotate immediately, by the action of the wheel 34 which in each of its revolutions drives the disk 28, the other disks being incremented as described above.

When the push button 31 is pressed again, this displaces the clutch in such a way that the chronograph gearing is no longer engaged with the final gear train. Thus the measurement is interrupted, the display of the measured time being fixed. The data can therefore be read. It will be found that this repeated pressing does not act on the member 84, since it is kept in the pushed-in position by the jumper-spring 90.

To reset the disks to zero, the push button 32 is pressed, activating the zero resetting lever 78 which, in a conventional way, causes the chronograph mechanism to be reset to zero. The lever 78 causes the pivoting of the operating lever 80 which acts simultaneously on the balances 82 and 86.

The balance 86 raises the levers 44, 144 and 244, by means of the lever 87 in the case of the last two. The levers 44, 144 and 244 operate the levers 46, 146 and 246 respectively, so that their pallets release the regulation systems 40, 140 and 240, shown in FIGS. 2, 3 and 4 respectively. The drive gearings 42, 142 and 242 can therefore rotate under the action of the springs contained in the barrels 43, 143 and 243.

At the same time, the balance 82 drives, by means of one of its fingers 84*a*, the positioning member 84, so that the hooks 84*b* are again located on the path of the pins 64*a*, 164*a* and 260*a*. The end of the balance 82 adjacent to the lever 86 engages in a notch in the latter, masked by the wheel 62, so that they remain engaged with each other while also keeping the positioning member 84 in the disk locking position. Clearly, the pins 64*a*, 164*a* and 260*a* are positioned so that they interact with the hooks 84*b* and stop the disks in a position such that the "0" digits appear in the apertures.

To restart a measurement, it is simply necessary to press the push button 31. The lever 76 initially drives the balance 82, which releases the lever 86. The levers 46, 146 and 246 are then no longer restrained, and swing under the action of the springs 48, 148 and 248 respectively. Some of their pallets fall into the cut-outs 52*d*, 152*d* and 252*d* of the cams 52*c*, 152*c* and 252*c*, while the others are positioned opposite the fingers 54*c*, 154*c* and 254*c* with which they interact. The clutch incorporated in the chronograph mechanism also connects the final gearing to the measured seconds wheel. This seconds wheel drives the wheel 34 which operates the drive means 36 of the units disk 28, as described above. A new measurement is then started.

It will be seen that, in the described mechanism, the levers 44, 46, 144, 146, 244 and 246 have cut-outs which can be used to balance and lighten them. In this way, the forces required to operate the mechanism and the sensitivity to impact are considerably reduced.

The display device described above is associated with a chronograph mechanism. The same device could easily be applied to a countdown mechanism, for example one of the type displaying a decreasing time, or used for starting regattas.

The barrels are rewound in a single operation. It is also possible to envisage providing the movement with a second rewinding crown, the barrel driving the final gearing and those driving the measured time display being wound independently, one by means of a crown positioned at three o'clock while the others are wound by means of a crown which may be positioned at nine o'clock, for example. It is also possible to envisage a quartz watch provided with a chronograph mechanism for example, in which the energy source of the watch is a battery, while the disks are driven by means of mechanical energy sources.

Clearly, the movement could also be equipped with an automatic rewinding mechanism which may or may not wind all the barrels.

In all cases, however, the energy supplied to the display device does not come from the barrel spring or motor which drives the final gearing.

Additionally, the means for providing links between the additional barrels and the display disk or disks can be varied in numerous ways, depending on the desired objective and the imagination of the manufacturer.

The watch as described is advantageously equipped with a power reserve indicator, for example that described in the application EP 03 405533.5, which provides an indication of the time for which the watch can operate normally, taking both the basic movement barrel and the units barrel into consideration.

The device described above is mounted directly on the bottom plate of the movement. It would also be possible to construct this device on an additional plate, thus forming a module to be fixed to the basic movement.

Thus, because of the characteristics of the movement according to the invention, it is possible to construct a watch with a display provided by large disks, without thereby loading the final gearing, and therefore without affecting the operating accuracy.

The invention claimed is:

1. A display device intended to be fitted to a watch movement of the type having a final gear train intended to drive, at least in a mediated way, means of displaying the time and an energy source driving the final gear train, the display device comprising:

a display disk for an additional function, a display gearing of which one moving part carries the display disk, a second energy source, connected mechanically to the display gearing, and operating means for the display gearing, designed so as to cause the gearing to be driven by the second energy source when the information for display has to be changed.

2. The device as claimed in claim 1, wherein the second energy source is mechanical and has winding means.

3. The device as claimed in claim 2, wherein the second energy source is a barrel.

4. The device as claimed in claim 3, wherein said device is intended to be fitted to a watch movement of the chronograph type, comprising:

chronograph gearing in which one moving part completes one revolution per minute, designed to carry means for displaying the seconds of the measured time, and a clutch designed to connect the chronograph to the gear train or disconnect it therefrom, and to cause the starting and stopping of the measurement of a period of time, and wherein the device has drive means controlled by the chronograph gearing and causing the display gearing to be driven by the barrel.

5. The device as claimed in claim 4, wherein the display gearing is designed so that the display disk displays measured times equal to or greater than one minute.

6. The device as claimed in claim 4, further comprising a plurality of display disks and a plurality of barrels, each barrel driving one disk.

7. The device as claimed in claim 3, further comprising:

a regulation system regulating the rotary movement of the display gearing, and a trigger mechanism operated, at least in a mediated way, by the final gear train, and causing the disk to be driven by the barrel, by means of the display gearing.

8. The device as claimed in claim 7, wherein the regulation system comprises a flywheel.

9. The device as claimed in claim 8, wherein the regulation system also has a cam provided with a locking member and rotating in synchronization with the flywheel and wherein the trigger mechanism comprises a lever designed so that it can occupy a first position in which it interacts with the locking member to immobilize the regulation system, a second position in which it releases the cam and allows the regulation system to rotate, and a third position in which it bears against the cam until it again interacts with the locking member.

10. The device as claimed in claim 1, also comprising:

a zero resetting mechanism comprising a positioning member, an index pin positioned on the moving part carrying the display disk and interacting with the member to position the disk, and operating means designed so that, when the zero resetting mechanism is activated, the barrel drives the moving part until the index pin interacts with the member for positioning the disk.

* * * * *